US011820034B2

(12) United States Patent
Pauda

(10) Patent No.: US 11,820,034 B2
(45) Date of Patent: Nov. 21, 2023

(54) TORTILLA SLICING ASSEMBLY

(71) Applicant: Luciano Pauda, Ulysses, KS (US)

(72) Inventor: Luciano Pauda, Ulysses, KS (US)

( * ) Notice: Subject to any disclaimer, the term of this patent is extended or adjusted under 35 U.S.C. 154(b) by 49 days.

(21) Appl. No.: 17/582,756

(22) Filed: Jan. 24, 2022

(65) Prior Publication Data

US 2023/0234253 A1 Jul. 27, 2023

(51) Int. Cl.

| | |
|---|---|
| ***B26D 7/02*** | (2006.01) |
| ***B65B 63/00*** | (2006.01) |
| ***B26D 3/24*** | (2006.01) |
| ***B26D 5/10*** | (2006.01) |

(52) U.S. Cl.

CPC ..... *B26D 3/24* (2013.01); *B26D 5/10* (2013.01)

(58) Field of Classification Search

CPC ... B26D 3/24; B26D 7/01; B26D 7/27; B26D 3/18; A21C 11/10; A21C 15/04; A21C 11/04; A21C 3/02; B65B 5/067; B65B 25/18; B26B 5/008; Y10S 83/932

USPC ..... 83/86, 89, 91, 167, 408, 425, 437, 454, 83/620, 648, 697, 762, 932, 467.1, 468.7; 30/286, 114, 273, 289, 302, 303, 315, 30/316; 53/514, 245, 513, 515

See application file for complete search history.

(56) References Cited

U.S. PATENT DOCUMENTS 1,052,904 A * 2/1913 Dunn ..... B26D 7/016 269/57
1,142,622 A * 6/1915 Reed et al. ..... B26D 7/30 83/77
1,186,056 A * 6/1916 Winkelmeyer ..... B26D 7/016 269/57
1,210,552 A * 1/1917 Silvius ..... B26D 7/016 269/57
1,472,224 A * 10/1923 Mellor ..... B26D 3/24 83/610
1,500,179 A * 7/1924 Bilodeau ..... B26D 3/24 83/454
1,549,964 A * 8/1925 Downey ..... B26D 3/24 83/761
1,585,259 A * 5/1926 Musser ..... B26D 3/24 83/416
1,800,706 A * 4/1931 Turnquist ..... B26D 3/245 83/225
2,906,020 A * 9/1959 Welsh ..... B26D 3/24 D7/673
5,148,655 A 9/1992 Salinas
5,417,409 A * 5/1995 Reddell ..... B25B 1/22 269/211
6,318,225 B1 11/2001 Longoria
7,480,999 B2 1/2009 Atwater
(Continued)

FOREIGN PATENT DOCUMENTS

EP 1759819 8/2006

*Primary Examiner* — Ghassem Alie

(57) ABSTRACT

A tortilla slicing assembly includes a disk that is mountable to a horizontal support surface. The disk has a plate which is rotatably disposed on the disk and a stack of tortillas can be positioned on top of the plate. A support frame is coupled to and extends upwardly from the disk. A cutting unit is pivotally disposed on the support frame and the cutting unit is urgeable downwardly on the support frame to cut the stack of tortillas. Furthermore, the plate is rotated a pre-determined amount each time the cutting unit is urged downwardly to cut the tortilla into a plurality of triangular chips.

12 Claims, 7 Drawing Sheets

(56) References Cited

U.S. PATENT DOCUMENTS

| | | | | |
|---|---|---|---|---|
| 10,864,648 | B2 | 12/2020 | Whitney | |
| 2007/0221029 | A1 * | 9/2007 | Freudinger ..... | B26D 3/245<br>83/633 |
| 2015/0135921 | A1 | 5/2015 | Martinez-Montes | |

* cited by examiner

TORTILLA SLICING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to slicing devices and more particularly pertains to a new slicing device for slicing tortillas into triangular chips. The device includes a platform that includes a rotating plate upon which a stack of tortillas can be placed. The device includes a support frame which extends upwardly from the platform and a cutting unit that is pivotally disposed on the support frame. The cutting unit includes a blade and the cutting unit can be urged downwardly such that the blade slices the stack of tortillas. The plate is continually rotated each time the stack of tortillas is sliced until the stack of tortillas is sliced into a plurality of triangular chips.

(2) Description of Related Art Including Information Disclosed Under 37 CFR 1.97 and 1.98

The prior art relates to slicing devices including a food slicer which includes a platform with a hole and a slicer which is urged downwardly through the hole for slicing a food product that is positioned on the platform. The prior art discloses an automated tortilla slicer which includes a conveyor belt and a motorized cutter that is urged upwardly and downwardly for cutting tortillas on the conveyor belt. The prior art discloses a foldable blade device that includes a plurality of blades that are radially oriented.

BRIEF SUMMARY OF THE INVENTION

An embodiment of the disclosure meets the needs presented above by generally comprising a disk that is mountable to a horizontal support surface. The disk has a plate which is rotatably disposed on the disk and a stack of tortillas can be positioned on top of the plate. A support frame is coupled to and extends upwardly from the disk. A cutting unit is pivotally disposed on the support frame and the cutting unit is urgeable downwardly on the support frame to cut the stack of tortillas. Furthermore, the plate is rotated a pre-determined amount each time the cutting unit is urged downwardly to cut the tortilla into a plurality of triangular chips.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
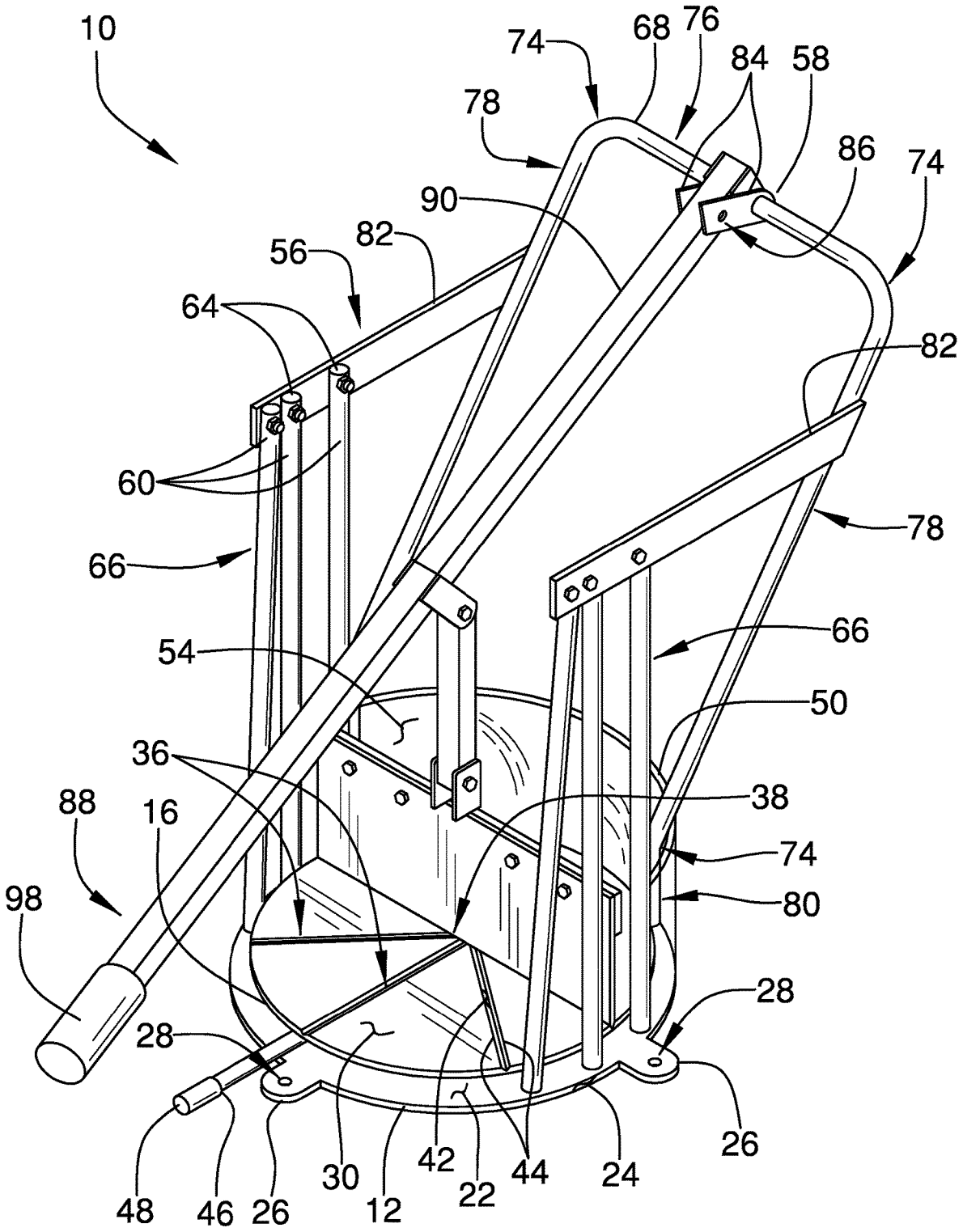
FIG. 1 is a perspective view of a tortilla slicing assembly according to an embodiment of the disclosure.
Figure 2:
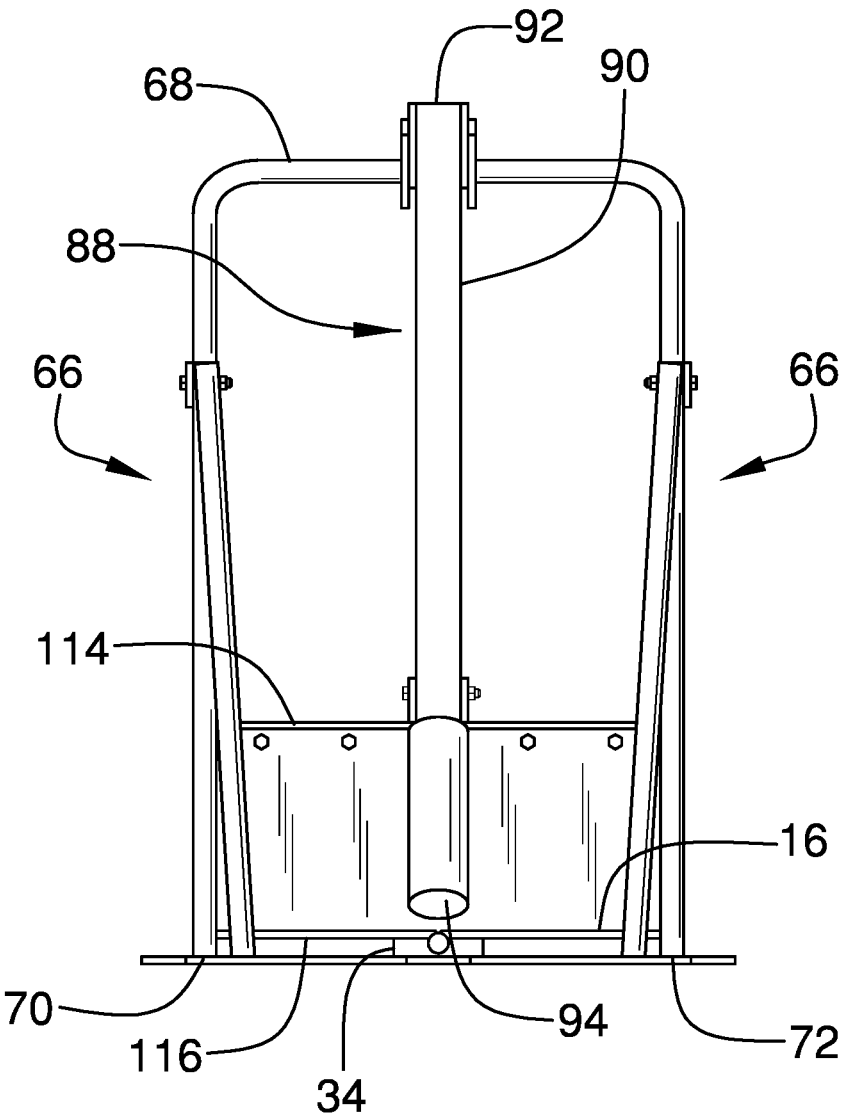
FIG. 2 is a front view of an embodiment of the disclosure.
Figure 3:
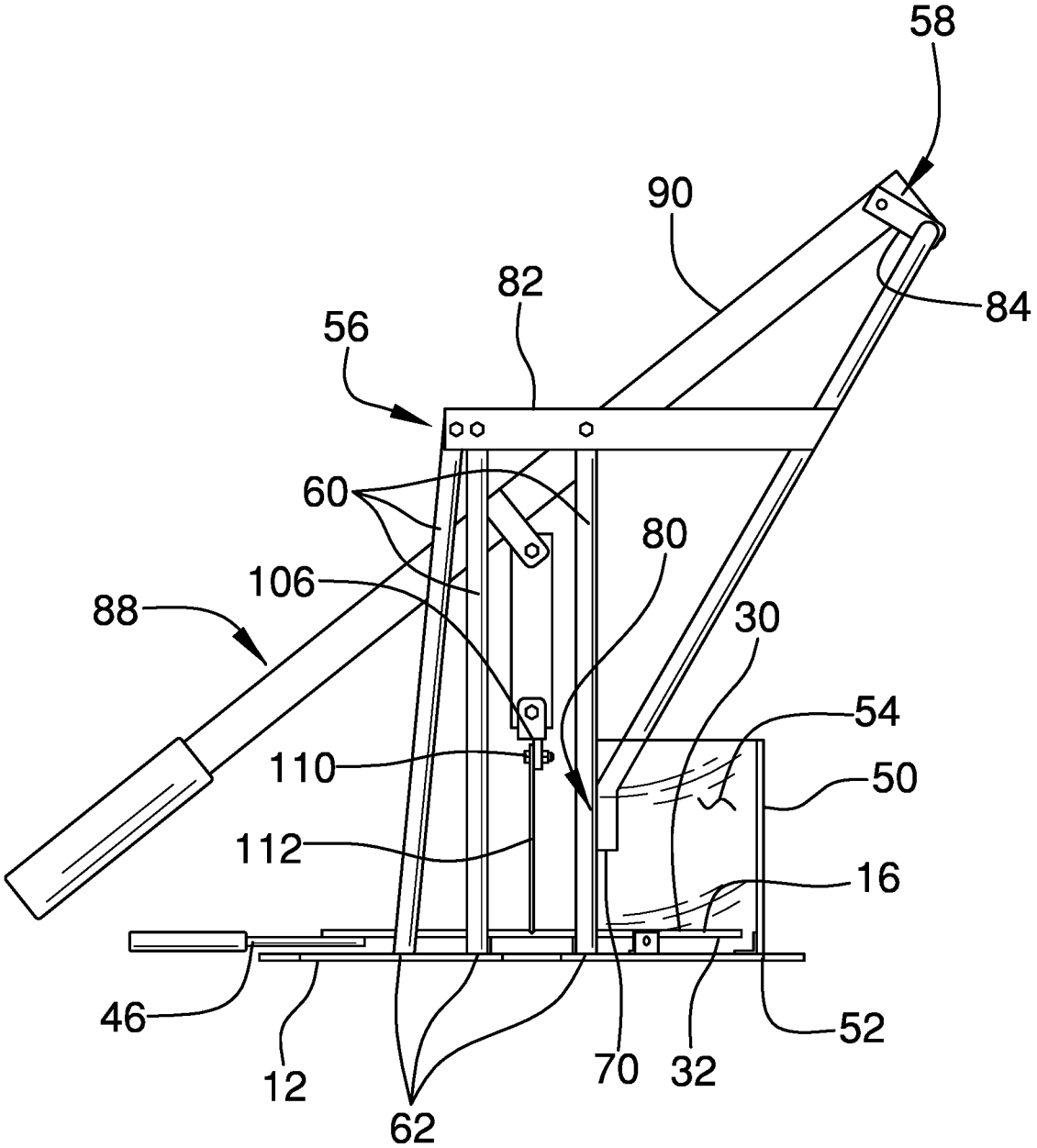
FIG. 3 is a left side view of an embodiment of the disclosure.
Figure 4:
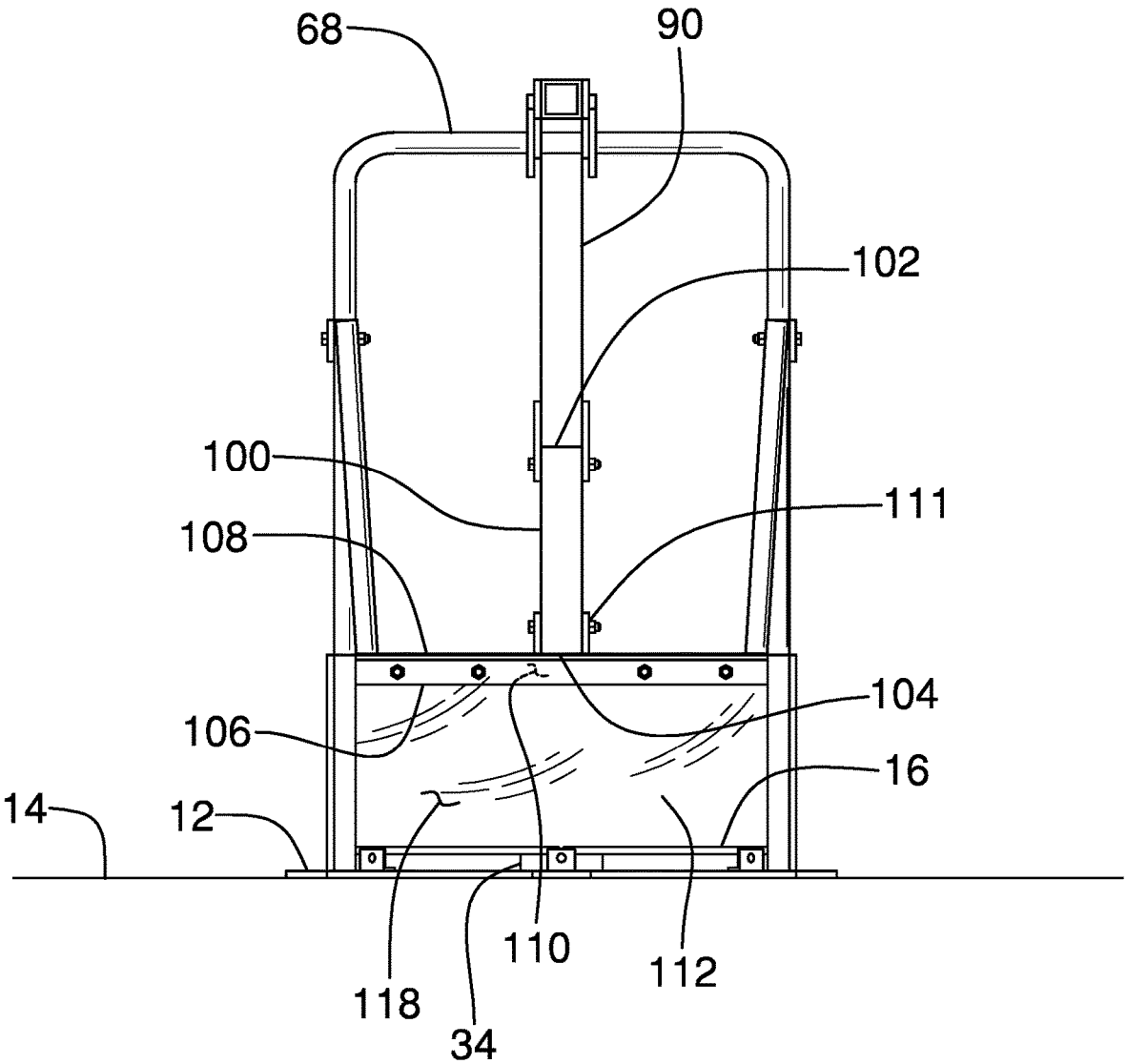
FIG. 4 is a back view of an embodiment of the disclosure.
Figure 5:
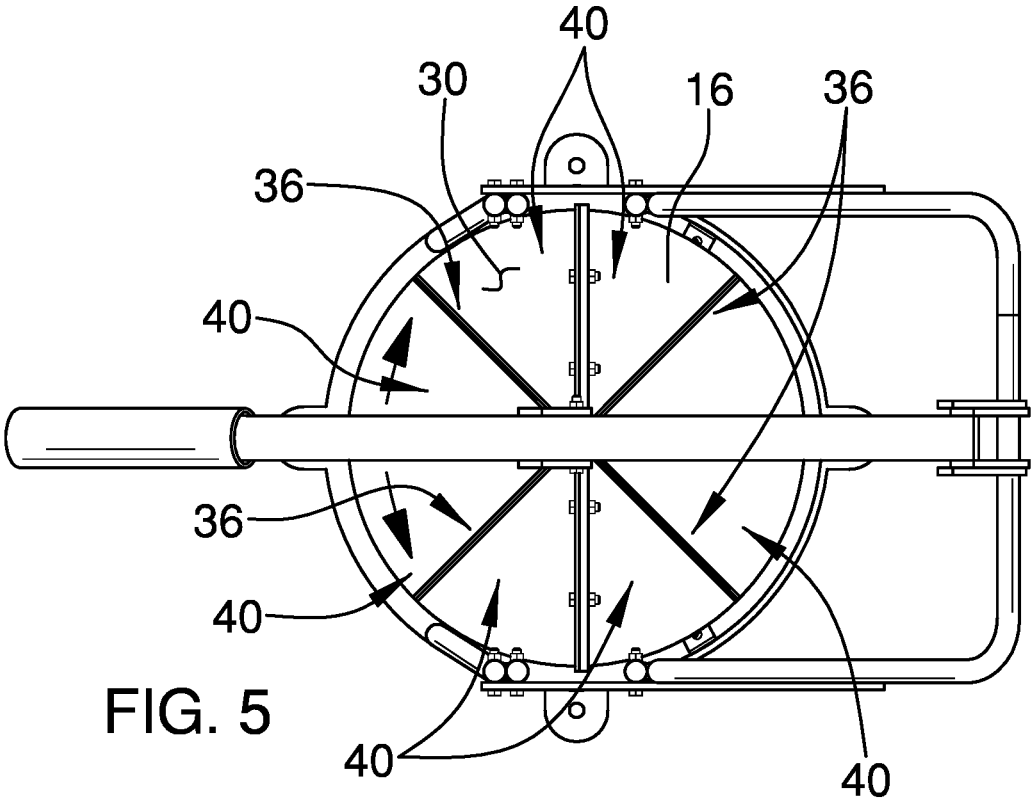
FIG. 5 is a top view of an embodiment of the disclosure.
Figure 6:
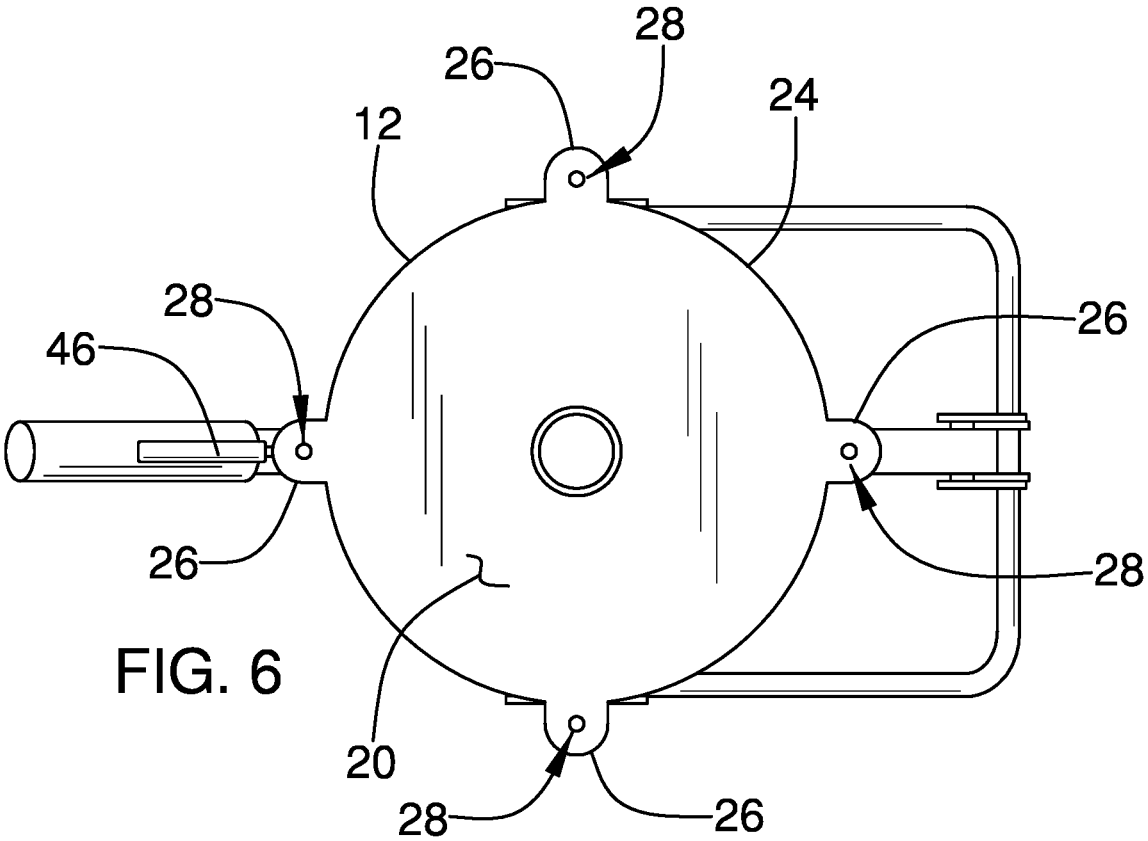
FIG. 6 is a bottom view of an embodiment of the disclosure.
Figure 7:
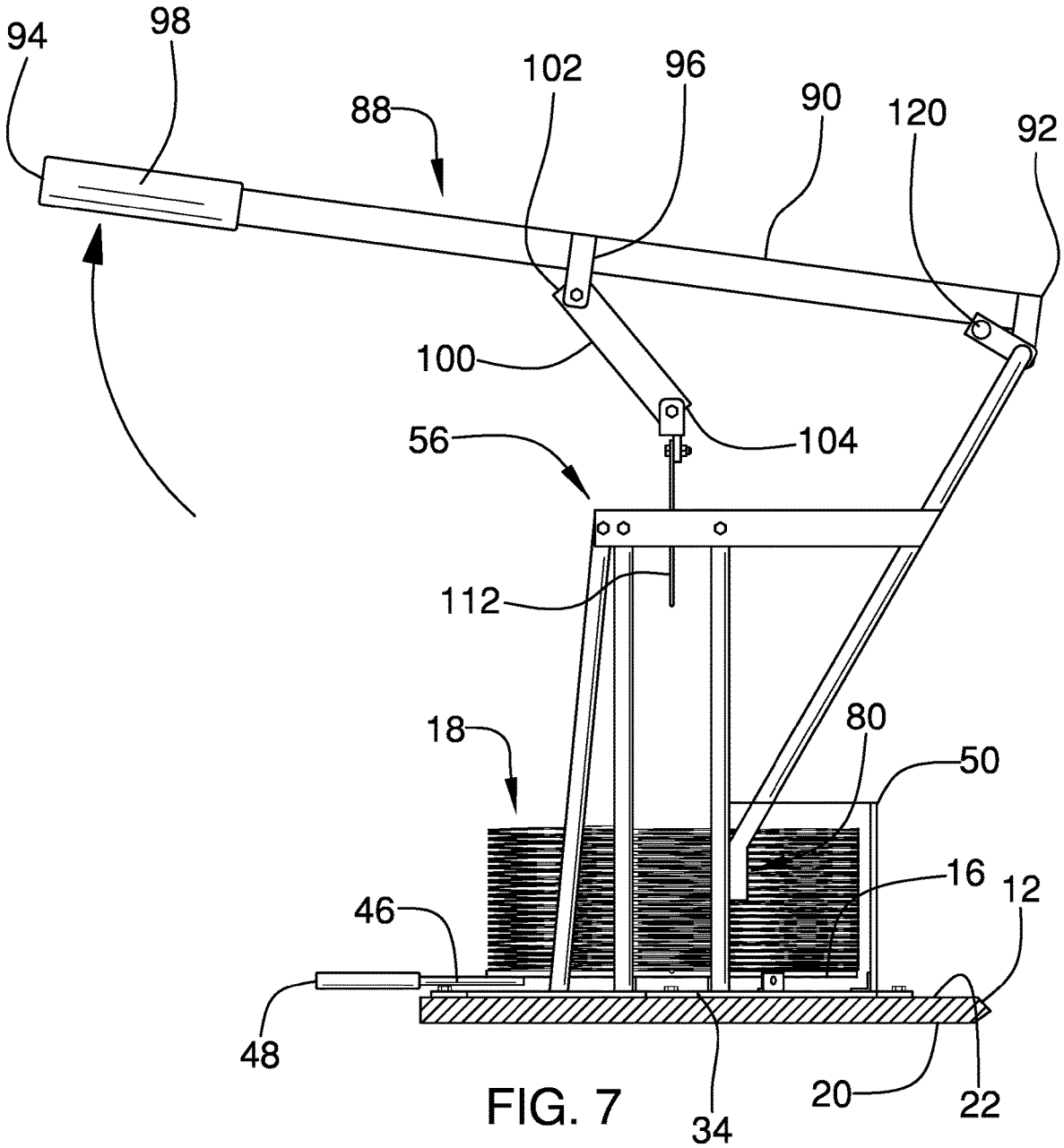
FIG. 7 is a perspective in-use view of an embodiment of the disclosure showing a cutting unit in a stored position.
Figure 8:
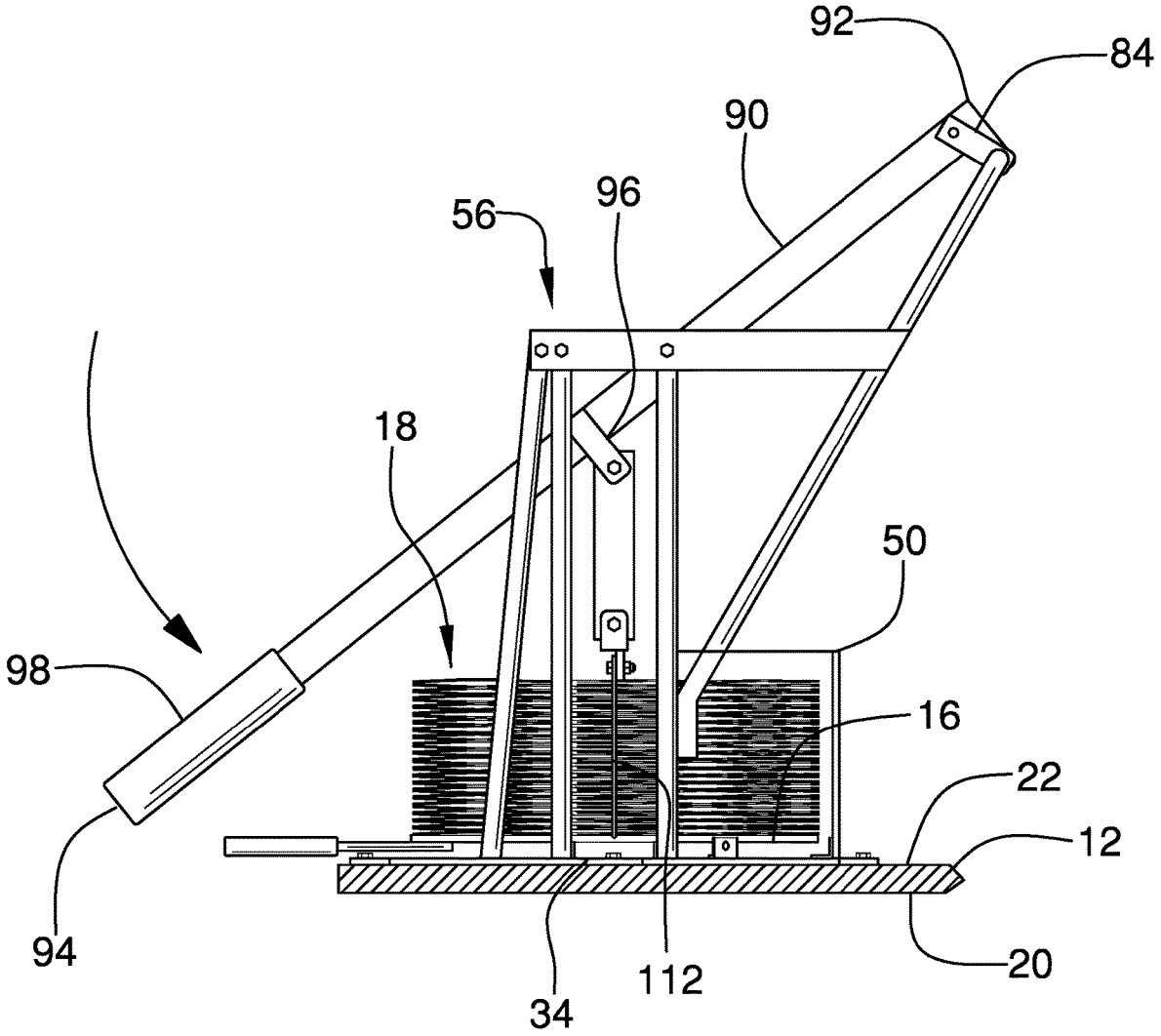
FIG. 8 is a perspective in-use view of an embodiment of the disclosure showing a cutting unit urged downwardly for cutting a stack of tortillas.

With reference now to the drawings, and in particular to FIGS. 1 through 8 thereof, a new slicing device embodying the principles and concepts of an embodiment of the disclosure and generally designated by the reference numeral 10 will be described.

As best illustrated in FIGS. 1 through 8, the tortilla slicing assembly 10 generally comprises a disk 12 that is mountable to a horizontal support surface 14, such as a table top or other similar type of horizontal support surface 14. A plate 16 is rotatably disposed on the disk 12 a stack of tortillas 18 can be positioned on top of the plate 16, and the plate 16 is rotatable about a vertical axis. The disk 12 has a bottom surface 20, a top surface 22 and a perimeter surface 24 extending between the top surface 22 and the bottom surface 20. The perimeter surface 24 has a plurality of lobes 26 each extending laterally away from the perimeter surface 24 and each of the lobes 26 has a hole 28 extending through the lobes 26. The lobes 26 are spaced apart from each other and are evenly distributed around the perimeter surface 24.

The bottom surface 20 rests on the horizontal support surface 14 thereby facilitating the hole 28 in each lobe 26 to accommodate a fastener for securing the disk 12 to the horizontal support surface 14. The plate 16 has an upper surface 30 and a lower surface 32, and the lower surface 32 is spaced from the top surface 22 of the disk 12. The plate 16 has a pivot 34 extending between the lower surface 32 and the top surface 22 of the disk 12 thereby facilitating the plate 16 to rotate about the pivot 34. The upper surface 30 of the plate 16 has a plurality of grooves 36 each extending downwardly toward the lower surface 32. The plurality of grooves 36 radiate outwardly from a center point 38 of the plate 16 such that the plurality of grooves 36 divides the plate 16 into a plurality of triangular sections 40. Each of the grooves 36 has a bounding surface 42 and the bounding surface 42 of each of the grooves 36 has a pair of intersecting sides 44 such that each of the grooves 36 has a V-shape.

A lever 46 is positioned between the disk 12 and the plate 16 such that the lever 46 can be manipulated. The lever 46 has an exposed end 48 which extends outwardly from the disk 12 and the plate 16. The lever 46 is biased into a locking position the lever 46 engaging the plate 16 thereby inhibiting the plate 16 from rotating on the disk 12. The lever 46 is urgeable into an unlocked position having the lever 46 disengaging the plate 16 thereby facilitating the plate 16 to rotate on the disk 12.

A stacking guide 50 is coupled to platform to stabilize the stack of tortillas 18 when the stack of tortillas 18 is positioned on the plate 16. The stacking guide 50 has a lower edge 52 and a first surface 54, and the lower edge 52 is coupled to the top surface 22 of the platform. The first surface 54 is concavely arcuate such that the stacking guide 50 curves along the perimeter surface 24 of the disk 12. A support frame 56 is coupled to and extends upwardly from the disk 12. The support frame 56 has a pivot point 58 integrated into the support frame 56 and the pivot point 58 is spaced upwardly from the disk 12.

The support frame 56 comprises a plurality of vertical members 60 that each has a bottom end 62 and a top end 64. The bottom end 62 is coupled to the top surface 22 of the disk 12 having each of the vertical members 60 extending upwardly from the disk 12. The vertical members 60 are arranged into a pair of sets 66 which are positioned on opposing sides of the disk 12 from each other. The support frame 56 includes a pivot member 68 which has a first end 70, a second end 72 and a series of bends 74 that are distributed between the first end 70 and the second end 72 to define a central portion 76 extending between a pair of outward portions 78. The outward portions 78 are perpendicularly oriented with the central portion 76 such that the pivot member 68 has a U-shape. Each of the first end 70 and the second end 72 is associated with a respective one of the outward portions 78.

A respective pair of the bends 74 is spaced from a respective one of the first end 70 and the second end 72 to define an angled section 80 of each of the outward portions 78. The angled section 80 of each of the outward portions 78 rests against a respective one of the vertical members 60. Additionally, each of the outward portions 78 angles rearwardly and upwardly from the respective vertical members 60 having the central portion 76 being horizontally oriented. The support frame 56 includes a pair of brackets 82 that is each coupled between the top end 64 of each of the vertical members 60 associated with a respective one of the sets 66 of vertical members 60 and a respective one of the outward portions 78 of the pivot member 68. The support frame 56 includes a pair of tabs 84 that is each coupled to and extends away from the central portion 76. Each of the tabs 84 is angled upwardly on the central portion 76 and each of the tabs 84 has an opening 86 extending through the tabs 84. Additionally, the tabs 84 are spaced apart from each other.

A cutting unit 88 is pivotally disposed on the pivot point 58 of the support frame 56 and the cutting unit 88 is urgeable downwardly on the support frame 56 to cut the stack of tortillas 18. The plate 16 is rotated a pre-determined amount each time the cutting unit 88 is urged downwardly. In this way the cutting unit 88 can cut the stack of tortillas 18 into a plurality of triangular chips. The cutting unit 88 is urgeable upwardly on the support frame 56 into a stored position.

The cutting unit 88 comprises a handle 90 that has a coupled end 92 and a free end 94, and the coupled end 92 is pivotally coupled to the central portion 76 of the pivot member 68 of the support frame 56. The handle 90 is positioned between the pair of tabs 84 on the central portion 76 and the handle 90 extends outwardly over the plate 16. The handle 90 has an engagement 96 extending downwardly from the handle 90 and the engagement 96 is centrally positioned between the coupled end 92 and the free end 94. A grip 98 extends around the handle 90 and the grip 98 extends from the free end 94 toward the coupled end 92. The grip 98 is comprised of a resiliently compressible material for enhancing comfort when gripping the grip 98.

The cutting unit 88 includes an arm 100 that has an upper end 102 and a lower end 104, and the upper end 102 is pivotally coupled to the engagement 96. The cutting unit 88 includes a cross member 106 that has an upper edge 108 and a front surface 110, and the cross member 106 has an engagement 111 extending upwardly from the upper edge 108. The engagement 111 on the upper edge 108 is centrally positioned on the upper edge 108 and the lower end 104 of the arm 100 is pivotally coupled to the engagement 111 on the upper edge 108. The cutting unit 88 includes a blade 112 that has a top edge 114, a bottom edge 116 and a rear surface 118 extending between the top edge 114 and the bottom edge 116. The blade 112 is fastened to the cross member 106 having the rear surface 118 abutting the front surface 110 and having the top edge 114 being aligned with the upper edge 108 of the cross member 106.

The bottom edge 116 is sharpened to slice the stack of tortillas 18 when the handle 90 is pivoted downwardly on the central portion 76 of the pivot member 68. Furthermore, the bottom edge 116 is aligned with a respective pair of the grooves 36 in the plate 16 when the handle 90 is pivoted downwardly. In this way the respective pair of grooves 36 facilitates the bottom edge 116 of the blade 112 to pass fully through the stack of tortillas 18. The cutting unit 88 includes a pin 120 that is extendable through the opening 86 in each of the tabs 84 on the central portion 76 of the pivot member 68 when the handle 90 is lifted. In this way the handle 90 can rest on the pin for retaining the handle 90 in a lifted position.

In use, the disk 12 is mounted to the support surface 14, a stack of tortillas 18 is placed on the plate 16 and the handle 90 is urged downwardly to cut the stack of tortillas 18. The lever 46 is urged into the unlocked position and the plate 16 is rotated to align a respective pair of grooves 36 with the blade 112. The handle 90 is urged downwardly again to cut the stack of tortillas 18 and the plate 16 is rotated again. The process of urging the handle 90 downwardly and rotating the plate 16 is repeated until the stack of tortillas 18 is cut into a plurality of triangular chips.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tortilla slicing assembly for slicing tortillas into triangular chips, said assembly comprising:

a disk being mountable to a horizontal support surface, a plate being rotatably disposed on said disk wherein said plate is configured to have a stack of tortillas positioned on top of said plate;

a stacking guide being coupled to a surface of the plate on which the tortillas are received wherein said stacking guide is configured to stabilize the stack of tortillas when the stack of tortillas is positioned on said plate;

a support frame being coupled to and extending upwardly from said disk, said support frame having a pivot point being integrated into said support frame, said pivot point being spaced upwardly from said disk;

a cutting unit being pivotally disposed on said pivot point of said support frame, said cutting unit being urgeable downwardly on said support frame wherein said cutting unit is configured to cut the stack of tortillas, said plate being rotated a pre-determined amount each time said cutting unit is urged downwardly wherein said cutting unit is configured to cut the tortilla into a plurality of triangular chips, said cutting unit urgeable upwardly on said support frame for positioning the cutting unit in a stored position;

wherein said Hate is rotatable about a vertical axis, said disk having a bottom surface, a top surface and a perimeter surface extending between said top surface and said bottom surface, said perimeter surface having a plurality of lobes each extending laterally away from said perimeter surface, each of said lobes having a hole extending through said lobes, said lobes being spaced apart from each other and being evenly distributed around said perimeter surface, said bottom surface resting on the horizontal support surface thereby facilitating each of said holes to accommodate a fastener for securing said disk to the horizontal support surface; and wherein said support frame comprises a plurality of vertical members, each of said vertical members having a bottom end and a top end, said bottom end being coupled to said top surface of said disk having each of said vertical members extending upwardly from said disk, said vertical members being arranged into a pair of sets being positioned on opposing sides of said disk from each other.

2. The assembly according to claim 1, wherein:

said plate has an upper surface and a lower surface, said lower surface being spaced from said top surface of said disk;

said plate having a pivot extending between said lower surface and said top surface of said disk thereby facilitating said plate to rotate about said pivot; and said upper surface of said plate has a plurality of grooves each extending downwardly toward said lower surface, said plurality of grooves radiating outwardly from a center point of said plate such that said plurality of grooves divides said plate into a plurality of triangular sections, each of said grooves having a bounding surface, said bounding surface of each of said grooves having a pair of intersecting sides such that each of said grooves has a V-shape.

3. The assembly according to claim 2, further comprising a lever being positioned between said disk and said plate wherein said lever is configured to be manipulated, said lever being biased into a locking position having said lever engaging said plate thereby inhibiting said plate from rotating on said disk, said lever being urgeable into an unlocked position having said lever disengaging said plate thereby facilitating said plate to rotate on said disk.

4. The assembly according to claim 1, wherein said stacking guide has a lower edge and a first surface, said lower edge being coupled to said top surface of said surface of the plate on which the tortillas are received, said first surface being concavely arcuate such that said stacking guide curves along said perimeter surface of said disk.

5. The assembly according to claim 1, wherein:

said support frame includes a pivot member having a first end, a second end and a series of bends being distributed between said first end and said second end to define a central portion extending between a pair of outward portions, said outward portions being perpendicularly oriented with said central portion such that said pivot member has a U-shape, each of said first end and said second end being associated with a respective one of said outward portions; and a respective pair of said bends being spaced from a respective one of said first end and said second end to define an angled section of each of said outward portions, said angled section of each of said outward portions resting against a respective one of said vertical members such that each of said outward portions angles rearwardly and upwardly from said respective vertical members having said central portion being horizontally oriented.

6. The assembly according to claim 5, wherein said support frame includes a pair of tabs, each of said tabs being coupled to and extending away from said central portion of said pivot member, said each of said tabs being angled upwardly on said central portion, each of said tabs having an opening extending through said tabs, said tabs being spaced apart from each other, said pair of tabs defining said pivot point on said support frame.

7. The assembly according to claim 6, Wherein said cutting unit comprises:

a handle having a coupled end and a free end, said coupled end being pivotally coupled to said central portion of said pivot member of said support frame, said handle being positioned between said pair of tabs on said central portion, said handle extending outwardly over said plate;

said handle has an engagement extending downwardly from said handle, said engagement being centrally positioned between said coupled end and said free end; and a grip extending around said handle, said grip extending from said free end toward said coupled end, said grip being comprised of a resiliently compressible material for enhancing comfort when gripping said grip.

8. The assembly according to claim 5, wherein said cutting unit includes:

an arm having an upper end and a lower end, said upper end being pivotally coupled to said engagement; and a cross member having an upper edge and a front surface, said cross member having an engagement extending upwardly from said upper edge, said engagement on said upper edge being centrally positioned on said upper edge, said lower end of said arm being pivotally coupled to said engagement on said upper edge.

9. The assembly according to claim 8, wherein said cutting unit includes a blade having an top edge, a bottom edge and a rear surface extending between said top edge and said bottom edge, said blade being fastened to said cross member having said rear surface abutting said front surface and said having said top edge being aligned with said upper edge of said cross member, said bottom edge being sharpened wherein said bottom edge is configured to slice the stack of tortillas when said handle is pivoted downwardly on said central portion of said pivot member.

10. The assembly according to claim 9, wherein:

said plate has a plurality of grooves; and said bottom edge being aligned with a respective pair of said grooves in said plate when said handle is pivoted downwardly wherein said pair of grooves is configured to facilitate said bottom edge to pass fully through the stack of tortillas.

11. The assembly according to claim 7, wherein said cutting unit includes a pin being extendable through said opening in each of said tabs on said central portion of said pivot member when said handle is lifted thereby facilitating said handle to rest on said pin for retaining said handle in a lifted position.

12. A tortilla slicing assembly for slicing tortillas into triangular chips, said assembly comprising:

a disk being mountable to a horizontal support surface, a plate being rotatably disposed on said disk wherein said plate is configured to have a stack of tortillas positioned on top of said plate, said plate being rotatable about a vertical axis, said disk having a bottom surface, a top surface and a perimeter surface extending between said top surface and said bottom surface, said perimeter surface having a plurality of lobes each extending laterally away from said perimeter surface, each of said lobes having a hole extending through said lobes, said lobes being spaced apart from each other and being evenly distributed around said perimeter surface, said bottom surface resting on the horizontal support surface thereby facilitating each of said holes to accommodate a fastener for securing said disk to the horizontal support surface, said plate having an upper surface and a lower surface, said lower surface being spaced from said top surface of said disk, said plate having a pivot extending between said lower surface and said top surface of said disk thereby facilitating said plate to rotate about said pivot, said upper surface of said plate having a plurality of grooves each extending downwardly toward said lower surface, said plurality of grooves radiating outwardly from a center point of said plate such that said plurality of grooves divides said plate into a plurality of triangular sections, each of said grooves having a bounding surface, said bounding surface of each of said grooves having a pair of intersecting sides such that each of said grooves has a V-shape;

a lever being positioned between said disk and said plate wherein said lever is configured to be manipulated, said lever being biased into a locking position having said lever engaging said plate thereby inhibiting said plate from rotating on said disk, said lever being urgeable into an unlocked position having said lever disengaging said plate thereby facilitating said plate to rotate on said disk;

a stacking guide being coupled to a surface of the plate on which the tortillas are received wherein said stacking guide is configured to stabilize the stack of tortillas when the stack of tortillas is positioned on said plate, said stacking guide having a lower edge and a first surface, said lower edge being coupled to said top surface of said surface of the plate on which the tortillas are received, said first surface being concavely arcuate such that said stacking guide curves along said perimeter surface of said disk;

a support frame being coupled to and extending upwardly from said disk, said support frame having a pivot point being integrated into said support frame, said pivot point being spaced upwardly from said disk, said support frame comprising:

a plurality of vertical members, each of said vertical members having a bottom end and a top end, said bottom end being coupled to said top surface of said disk having each of said vertical members extending upwardly from said disk, said vertical members being arranged into a pair of sets being positioned on opposing sides of said disk from each other;

a pivot member having a first end, a second end and a series of bends being distributed between said first end and said second end to define a central portion extending between a pair of outward portions, said outward portions being perpendicularly oriented with said central portion such that said pivot member has a U-shape, each of said first end and said second end being associated with a respective one of said outward portions, a respective pair of said bends being spaced from a respective one of said first end and said second end to define an angled section of each of said outward portions, said angled section of each of said outward portions resting against a respective one of said vertical members such that each of said outward portions angles rearwardly and upwardly from said respective vertical members having said central portion being horizontally oriented; and a pair of tabs, each of said tabs being coupled to and extending away from said central portion, said each of said tabs being angled upwardly on said central portion, each of said tabs having an opening extending through said tabs, said tabs being spaced apart from each other, said pair of tabs defining said pivot point on said support frame; and a cutting unit being pivotally disposed on said pivot point of said support frame, said cutting unit being urgeable downwardly on said support frame wherein said cutting unit is configured to cut the stack of tortillas, said plate being rotated a pre-determined amount each time said cutting unit is urged downwardly wherein said cutting unit is configured to cut the tortilla into a plurality of triangular chips, said cutting unit urgeable upwardly on said support frame for positioning said cutting unit in a stored position, said cutting unit comprising:

a handle having a coupled end and a free end, said coupled end being pivotally coupled to said central portion of said pivot member of said support frame, said handle being positioned between said pair of tabs on said central portion, said handle extending outwardly over said plate, said handle having an engagement extending downwardly from said handle, said engagement being centrally positioned between said coupled end and said free end;

a grip extending around said handle, said grip extending from said free end toward said coupled end, said grip being comprised of a resiliently compressible material for enhancing comfort when gripping said grip;

an arm having an upper end and a lower end, said upper end being pivotally coupled to said engagement;

a cross member having an upper edge and a front surface, said cross member having an engagement extending upwardly from said upper edge, said engagement on said upper edge being centrally positioned on said upper edge, said lower end of said arm being pivotally coupled to said engagement on said upper edge; and a blade having an top edge, a bottom edge and a rear surface extending between said top edge and said bottom edge, said blade being fastened to said cross member having said rear surface abutting said front surface and said having said top edge being aligned with said upper edge of said cross member, said bottom edge being sharpened wherein said bottom edge is configured to slice the stack of tortillas when said handle is pivoted downwardly on said central portion of said pivot member, said bottom edge being aligned with a respective pair of said grooves in said plate when said handle is pivoted downwardly wherein said pair of grooves is configured to facilitate said bottom edge to pass fully through the stack of tortillas; and a pin being extendable through said opening in each of said tabs on said central portion of said pivot member when said handle is lifted thereby facilitating said handle to rest on said pin for retaining said handle in a lifted position.

* * * * *